US009307882B2

(12) United States Patent
Zhu

(10) Patent No.: US 9,307,882 B2
(45) Date of Patent: Apr. 12, 2016

(54) SELF-WRUNG FLAT MOP

(71) Applicant: Jiaxing Jackson Travel Products Co.,Ltd., Jiaxing (CN)

(72) Inventor: Xue Lin Zhu, Jiaxing (CN)

(73) Assignee: JIAXING JACKSON TRAVEL PRODUCTS CO., LTD., Jiaxing, Zhejiang (CN)

( * ) Notice: Subject to any disclaimer, the term of this patent is extended or adjusted under 35 U.S.C. 154(b) by 90 days.

(21) Appl. No.: 14/372,263

(22) PCT Filed: Aug. 8, 2013

(86) PCT No.: PCT/CN2013/081063

§ 371 (c)(1),
(2) Date: Jul. 15, 2014

(87) PCT Pub. No.: WO2015/003419

PCT Pub. Date: Jan. 15, 2015

(65) Prior Publication Data

US 2015/0113750 A1 Apr. 30, 2015

(30) Foreign Application Priority Data

Jul. 9, 2013 (CN) ..... 2013 1 0286019

(51) Int. Cl.

| | |
|---|---|
| ***A47L 13/142*** | (2006.01) |
| ***A47L 13/146*** | (2006.01) |
| ***A47L 13/258*** | (2006.01) |
| ***A47L 13/44*** | (2006.01) |
| ***B25G 3/38*** | (2006.01) |

(52) U.S. Cl.

CPC ..... *A47L 13/142* (2013.01); *A47L 13/146* (2013.01); *A47L 13/258* (2013.01); *A47L 13/44* (2013.01); *B25G 3/38* (2013.01)

(58) Field of Classification Search

CPC ..... A47L 13/14; A47L 13/142; A47L 13/146; A47L 13/254–13/258

USPC ..... 15/119, 1, 119.2, 120.1, 120.2, 147.1, 15/147.2, 228

See application file for complete search history.

(56) References Cited

FOREIGN PATENT DOCUMENTS

| | | | |
|---|---|---|---|
| CN | 201205264 | Y | 3/2009 |
| CN | 202489890 | U | 10/2012 |
| CN | 203280343 | U | 11/2013 |
| CN | 203388809 | U | 1/2014 |
| DE | 20306274 | U1 | 8/2003 |
| FR | 2539977 | * | 8/1984 |
| FR | 2585554 | * | 2/1987 |

* cited by examiner

*Primary Examiner* — Mark Spisich
(74) *Attorney, Agent, or Firm* — Muncy, Geissler, Olds & Lowe, P.C.

(57) ABSTRACT

A self-wrung flat mop comprises a plate, a handle, a cleaning element connected the plate, a swivel member, an external ratchet and a sleeve. The plate includes a middle plate and two side plates that are hinged on two sides of the middle plate. The swivel member includes a lower end connected to the cleaning element and an upper end run through the middle plate to connect to the handle in a non-turnable manner. The external ratchet is fixedly coupled on the handle. The sleeve is coupled on the handle and includes an internal ratchet to mate the external ratchet. The sleeve is connected to the middle plate in a non-turnable manner. After the cleaning element is washed and cleaned, it can be wrung to squeeze water without being removed or touched, thus is more convenient in use and more hygienic.

5 Claims, 4 Drawing Sheets

SELF-WRUNG FLAT MOP

FIELD OF THE INVENTION

The present invention relates to a cleaning equipment and particularly to a self-wrung flat mop.

BACKGROUND OF THE INVENTION

Flat mops are widely used nowadays. In general, a flat mop includes a plate and a handle hinged on an upper portion of the plate. The plate has a lower portion attached to a cleaning element such as a cotton slip. However, after the cleaning element is being washed and cleaned, it has to be removed manually and wrung to squeeze the water. It is a tedious operation and also not hygienic.

SUMMARY OF THE INVENTION

The primary object of the present invention is to provide a self-wrung flat mop that can easily and hygienically wring a cleaning element.

To achieve the foregoing object the present invention provides a self-wrung flat mop that includes a plate, a handle, a cleaning element, a swivel member, an external ratchet, a sleeve, a transition tube and a universal joint. The cleaning element is located beneath the plate. The plate includes a middle plate and two side plates that are hinged on two sides of the middle plate through two torsional springs respectively. The cleaning element has two ends connected respectively to outer sides of the two side plates. The swivel member has a lower end connected to the middle portion of the cleaning element and an upper end run through an opening formed in the middle portion of the middle plate to connect to the handle in a non-turnable manner. The external ratchet is fixedly coupled on the handle. The sleeve is coupled on the handle and includes at least one upright slide groove formed on an inner surface thereof and an internal ratchet formed on the inner surface thereof to mate the external ratchet. The transition tube is coupled on the handle and includes an upper end coupled with the sleeve and a lower end movably hinged on an upper end of the universal joint. The universal joint includes a lower end movably hinged on a connecting seat formed on the middle of the middle plate. The transition tube includes at least one slider formed on the outer surface of the upper end thereof to mate the upright slide groove of the sleeve so that the sleeve can be connected to the middle plate in a non-turnable manner.

In one embodiment the self-wrung flat mop further includes a first connecting member and a second connecting member. The handle has a lower end connected to the first connecting member which is hinged on an upper end of the second connecting member. The second connecting member runs through the sleeve with the first connecting member and the handle, and has a lower end hinged on the upper end of the swivel member such that the swivel member and the handle are connected in a non-turnable manner.

In another embodiment the swivel member has a connector formed at the upper end thereof. The connector extends through the opening of the middle plate and is positioned in the middle of the connecting seat of the middle plate.

In yet another embodiment, the swivel member has two second hooks formed at the lower end thereof, and the cleaning element has two hanging rings formed in the middle portion thereof. The two second hooks are coupled with the two hanging rings respectively to connect the swivel member and the cleaning element.

In yet another embodiment each of the two side plates has at least one first hook formed on the outer end thereof. The cleaning element has two connecting rope formed on two ends thereof to couple on the first hooks.

The invention, by means of the structure set forth above, after the cleaning element is washed and cleaned, a user can take the self-wrung flat mop, with one hand gripping the sleeve in a still manner, and another hand swiveling the handle to drive the middle portion of the cleaning element to swivel through the swivel member, thereby the middle portion of the cleaning element can be swiveled and wrung gradually to generate stretching forces to two ends thereof, so that the outer ends of the two side plates are flipped respectively towards the cleaning element and close to each other in a juxtaposed manner, while the handle can be swiveled continuously until the cleaning element is wrung to squeeze the water remained inside. Hence during the wringing process of the cleaning element there is no need for the user to remove the cleaning element, and no contact with the cleaning element occurs, thus it is more convenient and more hygienic in use.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
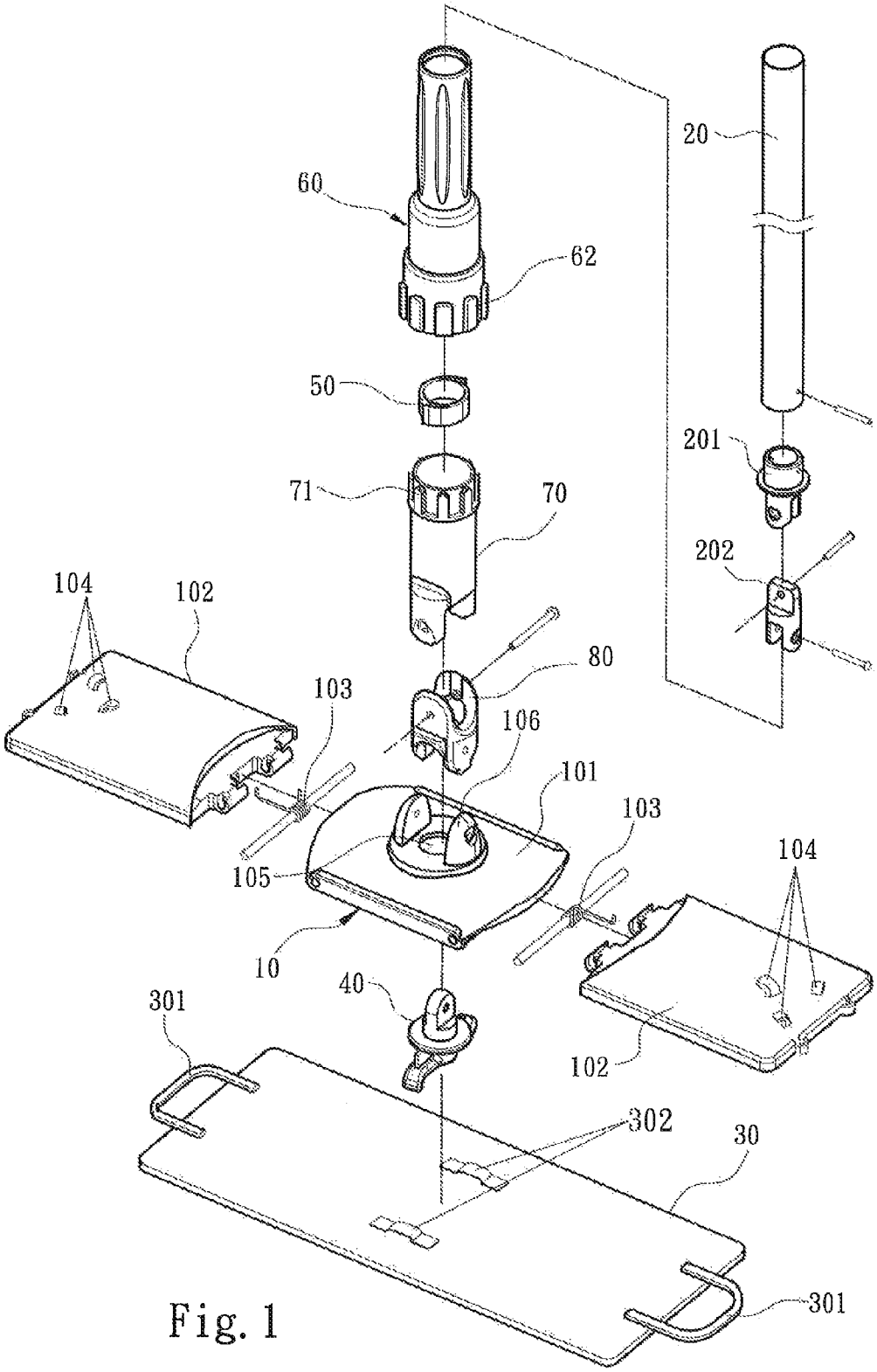
FIG. 1 is an exploded view of the self-wrung flat mop of the invention.
Figure 2:
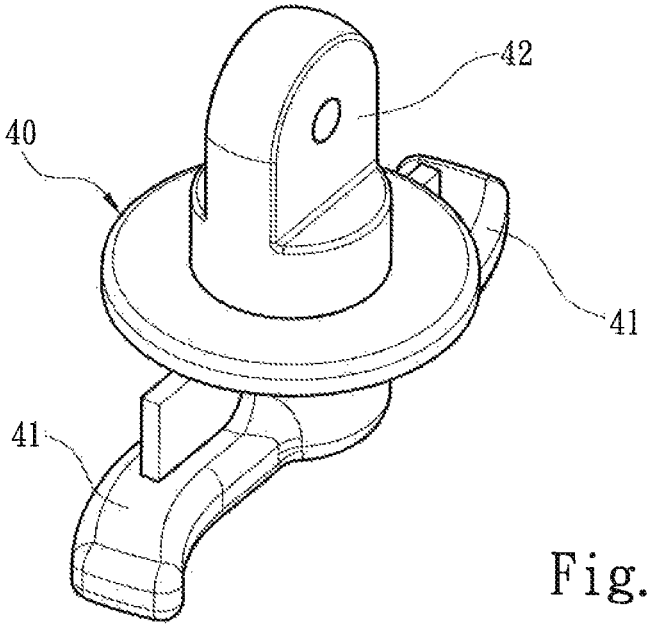
FIG. 2 is a perspective view of the swivel member of the self-wrung flat mop according to FIG. 1.

Please referring to FIGS. 1 through 4, the present invention aims to provide a self-wrung flat mop which includes a plate 10, a handle 20, a cleaning element 30, a swivel member 40, an external ratchet 50, a sleeve 60, a transition tube 70 and a universal joint 80. The cleaning element 30 is located beneath the plate 10. The plate 10 includes a middle plate 101 and two side plates 102 located at two sides of the middle plate 101. The middle plate 101 has two ends each is hinged on one of the two side plates 102 through a torsional spring 103 so that the two side plates 102 can be flipped towards the middle plate 101 when subject to an inward drawing force. Each side plate 102 has at least one first hook 104 at an outer end thereof. As shown in FIG. 1, three first hooks 104 are provided on each side plate 102 in this embodiment. The cleaning element 30 has two ends each has a connecting rope 301 which in one embodiment is preferably an elastic rope such as an elastic band or rubber band. When in use the connecting ropes 301 are coupled on the first hooks 104 of each side plate 102.

Please referring to FIGS. 2 through 5, the swivel member 40 has a connector 42 formed on an upper end thereof and two second hooks 41 formed at a lower end thereof. As shown in FIG. 1, the connector 42 of the swivel member 40 is extended through an opening 105 formed in the middle portion of the middle plate 101, and positioned in the middle of a connecting seat 106 formed on the middle portion of the middle plate 101. The cleaning element 30 further has two hanging rings 302 formed in the middle portion thereof. Each second hook 41 of the swivel member 40 can be coupled with one hanging ring 302. When the swivel member 40 is swiveled, the two second hooks 41 drive the two hanging rings 302 swiveling so that the middle portion of the cleaning element 30 also is swiveled and retracted inwards.

Figure 3:
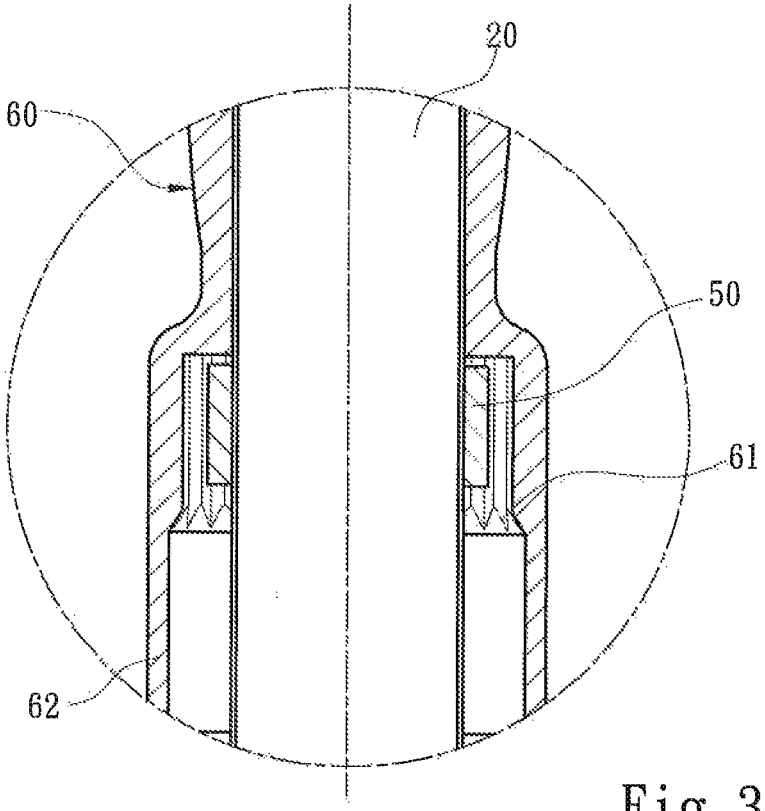
FIG. 3 is a fragmentary sectional view of the self-wrung flat mop according to FIG. 1 showing the internal ratchet and the external ratchet mating each other.
Figure 4:
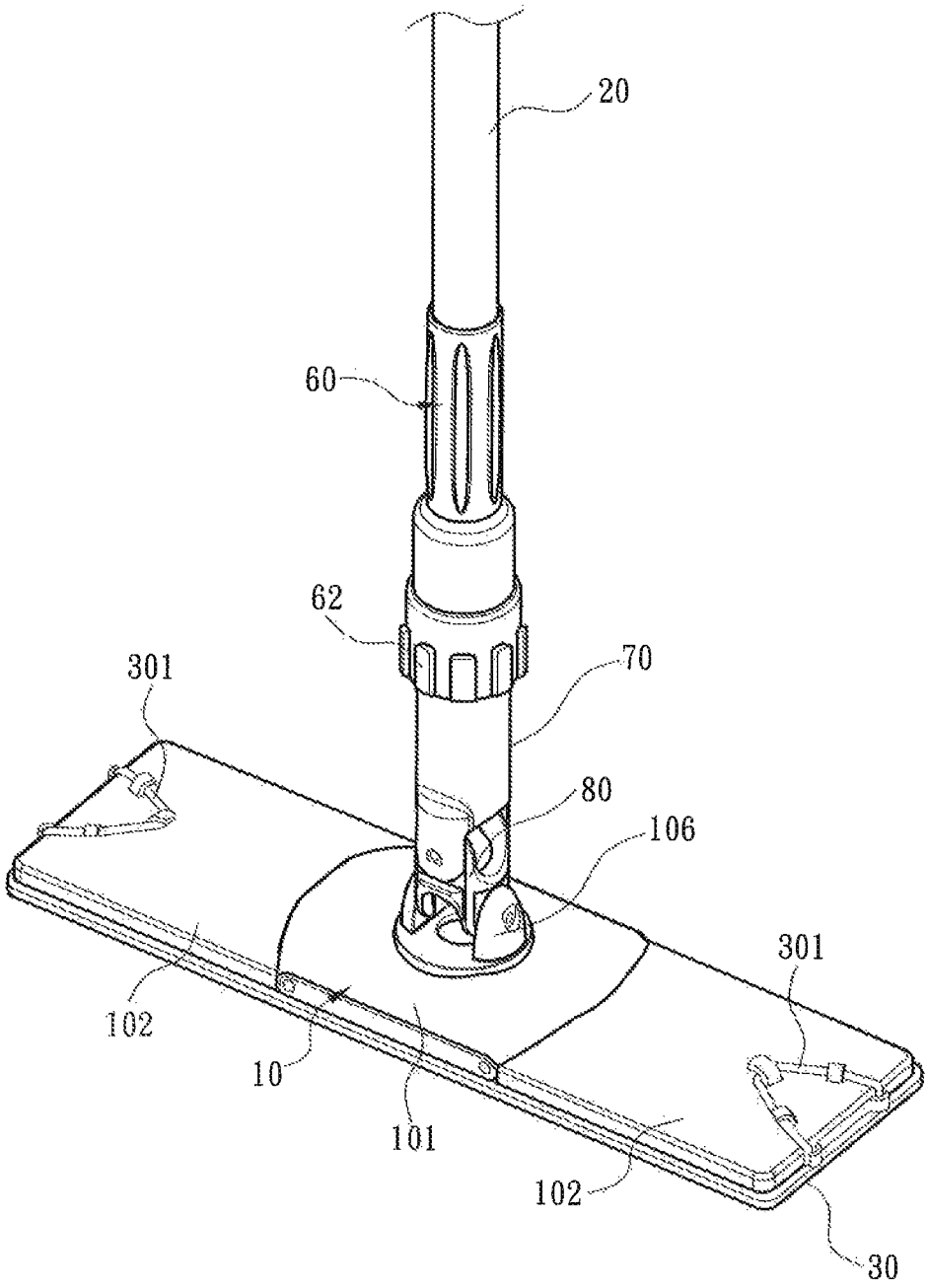
FIG. 4 is a perspective view of the self-wrung flat mop of the invention after assembly.
Figure 5:
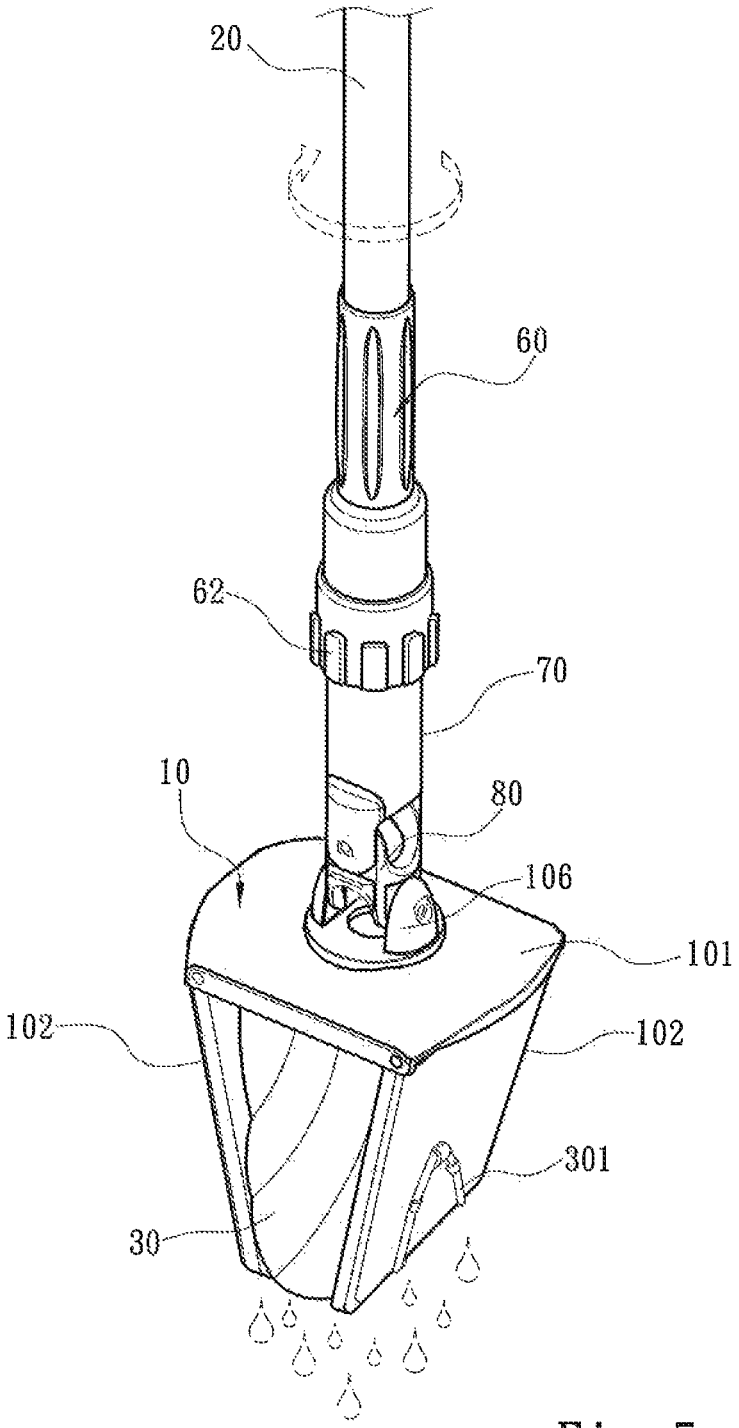
FIG. 5 is a schematic view of the self-wrung flat mop of the invention showing the wringing process.

Please also referring to FIG. 3, the external ratchet 50 is coupled on the handle 20. The sleeve 60 is coupled on the handle 20. More specifically, in one embodiment the handle 20 can have a retaining mechanism (not shown in the drawings) to confine the sleeve 60 from sliding away from the transition tube 70 and disengaging therewith. Furthermore, the sleeve 60 has an internal ratchet 61 formed on an inner surface thereof to mate the external ratchet 50. By engaging the internal ratchet 61 with the external ratchet 50, the handle 20 can swivel merely in one direction against the sleeve 60.

Please also referring to FIGS. 1 and 3, the transition tube 70 is coupled on the handle 20, and has an upper end coupled with the sleeve 60 and a lower end movably connected to an upper end of the universal joint 80. The universal joint 80 has a lower end movably connected to the connecting seat 106 in the middle portion of the middle plate 101 such that the transition tube 70 cannot swivel against the plate 10. The transition tube 70 has at least one slider 71 formed on an outer surface of the upper end. During assembly, the sleeve 60 is coupled on the upper end of the transition tube 70. The sleeve 60 further has at least one upright slide groove 62 formed on an inner surface thereof to mate the slider 71. In one embodiment, the upright slide groove 62 can be annularly arranged on the sleeve 60 and indented towards a direction away from the handle 20, as shown in FIGS. 1 and 3. After the sleeve 60 and the transition tube 70 are assembled, the slider 71 is inserted in the upright slide groove 62 and confines the sleeve 60 to slide only up and down against the transition tube 70 without swiveling against the transition tube 70. After assembly, the sleeve 60 and the transition tube 70 also cannot swivel against the plate 10. The handle 20 has a lower end connected to a first connecting member 201 which is connected to an upper end of a second connecting member 202. During assembly of the invention, the first connecting member 201, the second connecting member 202 and the handle 20 are assembled in advanced, and run through the sleeve 60 and the transition tube 70; then the lower end of the second connecting member 202 is connected to the connector 42. Thus the upper end of the swivel member 40 is hinged on the middle portion of the middle plate 101 and also connected with the handle 20 in a non-turnable manner. The non-turnable manner means that after the handle 20 and the swivel member 40 are connected together, the swivel member 40 cannot swivel against the handle 20 axially. Furthermore, in one embodiment of the invention the connector 42 and the lower end of the handle 20 have respectively at least one aperture for disposing at least one pin to couple the connector 42 and the handle 20 together.

Please referring to FIGS. 1 through 5, when the self-wrung flat mop of the invention is in use, first, the sleeve 60 is pushed toward the transition tube 70 to insert the slider 71 into the upright slide groove 62, hence the sleeve 60 can slide up and down against the transition tube 70 without swiveling, and the sleeve 60 also cannot swivel against the plate 10; in addition, while the sleeve 60 is moved towards the transition tube 70 the external ratchet 50 also is engaged with the internal ratchet 61 so that after the sleeve 60 is connected to the transition tube 70. Hence, a user can grip the sleeve 60 by one hand and swivel the handle 20 by another hand. Due to the handle 20 is confined by the sleeve 60 that can swivel only in one direction, the handle 20 also can drive the swivel member 40 to swivel only in one direction; meanwhile, the second hook 41 drives the hanging ring 302 of the cleaning element 30 to swivel the middle portion of the cleaning element 30. While the middle portion of the cleaning element 30 is swiveled and wrung, its two ends generate drawing forces; as the two outer ends of the cleaning element 30 are connected to the first hooks 104 of the two side plates 102 via the connecting ropes 301, the outer end of each side plate 102 receives the drawing force generated by the swivel and wringing of the cleaning element 30, thereby flips towards the middle plate 101 until the two outer ends of the cleaning element 30 are moved close to each other. As a result, when the user continuously swivels the handle 20 the cleaning element 30 can be wrung to squeeze water away. After the water has been wrung out from the cleaning element 30, user can push the sleeve 60 in a direction away from the transition tube 70 to separate the upright slide groove 62 and the slider 71, so that the handle 20 is no longer confined to swivel merely in one direction and can drive the swivel member 40 to swivel freely, and also drive the cleaning element 30 to swivel in another direction opposite to the wringing direction, thus the drawing force of the two outer ends of the cleaning element 30 is absent. In the meantime, the torsional springs 103 immediately provides a return force to flip the two side plates 102 toward the sleeve 60 so that the cleaning element 30 is returned to the pre-wrung condition.

As a conclusion, on the self-wrung flat mop of the invention, the sleeve and the transition tube cannot be swiveled against each other after they are assembled together, so that user can hold the sleeve by one hand and swivel the handle by another hand to flip the two side plates toward the middle plate to wring the cleaning element. Thereby, after the cleaning element has been washed and cleaned it can be wrung to squeeze the water without the need of removing or touched by the user, it is not only more convenient in use, also is more hygienic.

What is claimed is:

1. A self-wrung flat mop, comprising a plate, a handle and a cleaning element located beneath the plate, wherein:

the self-wrung flat mop further includes a swivel member, an external ratchet, a sleeve, a transition tube and a universal joint; the plate including a middle plate and two side plates that are hinged on two sides of the middle plate through two torsional springs respectively, the cleaning element including two ends connected respectively to outer ends of the two side plates, the swivel member including a lower end connected to the middle portion of the cleaning element and an upper end run through an opening formed in the middle portion of the middle plate to connect to the handle in a non-turnable manner; the external ratchet being fixedly coupled on the handle, the sleeve being coupled on the handle and including at least one upright slide groove formed on an inner surface thereof and an internal ratchet formed on the inner surface thereof to mate the external ratchet, the transition tube being coupled on the handle and including an upper end coupled with the sleeve and a lower end movably connected to an upper end of the universal joint, the universal joint including a lower end movably connected to a connecting seat formed on the middle portion of the middle plate; the transition tube including at least one slider formed on an outer surface of the upper end thereof to mate the upright slide groove of the sleeve, such that the sleeve being connected to the middle plate in a non-turn able manner.

2. The self-wrung flat mop of claim 1 further including a first connecting member and a second connecting member, the handle including a lower end connected to the first connecting member which is connected to an upper end of the second connecting member, the second connecting member run through the sleeve with the first connecting member and the handle and including a lower end connected to the upper end of the swivel member, such that the swivel member is connected to the handle in a non-turnable manner.

3. The self-wrung flat mop of claim 1, wherein the swivel member including a connector which is formed at the upper end thereof and extended through the opening of the middle plate to be positioned in the middle of the connecting seat of the middle plate.

4. The self-wrung flat mop of claim 1, wherein the swivel member includes two second hooks at the lower end thereof, the cleaning element including two hanging rings in the middle portion thereof to be coupled on the two second hooks respectively so that the swivel member is connected to the middle portion of the cleaning element.

5. The self-wrung flat mop of claim 1, wherein each of the two side plate includes at least one first hook at the outer end thereof, the cleaning element including two connecting rope at two ends thereof to be coupled on the first hooks respectively.

* * * * *